US009003583B2

(12) United States Patent
Schnake et al.

(10) Patent No.: US 9,003,583 B2
(45) Date of Patent: Apr. 14, 2015

(54) HIDDEN MATTRESS-RETENTION MECHANISM

(71) Applicant: L & P Property Management Company, South Gate, CA (US)

(72) Inventors: Christopher John Schnake, Carthage, MO (US); William Robert Rohr, Joplin, MO (US)

(73) Assignee: L & P Property Management Company, South Gate, CA (US)

( * ) Notice: Subject to any disclaimer, the term of this patent is extended or adjusted under 35 U.S.C. 154(b) by 0 days.

(21) Appl. No.: 13/863,748

(22) Filed: Apr. 16, 2013

(65) Prior Publication Data

US 2014/0304914 A1 Oct. 16, 2014

(51) Int. Cl.

| | |
|---|---|
| ***A47C 31/00*** | (2006.01) |
| ***A61G 7/05*** | (2006.01) |
| ***A61G 7/002*** | (2006.01) |

(52) U.S. Cl.
CPC . *A61G 7/05* (2013.01); *A61G 7/002* (2013.01)

(58) Field of Classification Search
USPC ..... 5/411, 425, 193, 428, 617, 618, 651, 5/658, 613, 659, 485
See application file for complete search history.

(56) References Cited

U.S. PATENT DOCUMENTS

| | | | | |
|---|---|---|---|---|
| 2,995,762 | A | 8/1961 | Albinson | |
| 3,350,726 | A | 11/1967 | Gardner | |
| 4,017,919 | A | 4/1977 | Hemmeter | |
| 4,199,831 | A | 4/1980 | Muller | |
| 5,218,729 | A | 6/1993 | Walton | |
| 5,499,410 | A | 3/1996 | Assink | |
| 5,628,080 | A | 5/1997 | Quintile | |
| 6,889,396 | B2 | 5/2005 | Weinman | |
| 7,810,194 | B2 | 10/2010 | Clenet | |
| 8,176,582 | B2 | 5/2012 | Beard et al. | |
| 2012/0017373 | A1 * | 1/2012 | Alzoubi et al. | 5/613 |

* cited by examiner

*Primary Examiner* — Peter M Cuomo
*Assistant Examiner* — Brittany Wilson
(74) *Attorney, Agent, or Firm* — Shook, Hardy & Bacon LLP

(57) ABSTRACT

A mattress-retention mechanism is provided that prevents a mattress from moving on an adjustable bed during articulation. The mechanism includes a rod held between two retainer ends. The rod is held on the mattress bottom within a tube. The retainer ends have a downwardly extending leg that passes through a corresponding hole in the bed base. Each leg has a toothed rack that can be engaged by a latch. Each retainer end is held in place by a latch assembly coupled to the bottom of the adjustable bed base. The latch assembly has a retainer block that holds a latch, and a biasing mechanism. The biasing mechanism operates to move the latch into engagement with the leg of the retainer end. The mechanism maintains the mattress in place relative to the adjustable bed base, while being hidden from view.

15 Claims, 5 Drawing Sheets

HIDDEN MATTRESS-RETENTION MECHANISM

CROSS-REFERENCE TO RELATED APPLICATIONS

Not applicable.

STATEMENT REGARDING FEDERALLY SPONSORED RESEARCH OR DEVELOPMENT

Not applicable.

TECHNICAL FIELD

The present invention generally relates to a mechanism for securing a mattress on an automated articulating bed. More particularly, the invention relates to a mattress-retention mechanism for preventing a mattress from moving on the base of an automated bed during articulation.

BACKGROUND OF THE INVENTION

Automated, articulating beds are increasing in popularity and use. In a typical adjustable bed, a base with a series of connected panels is moved into a variety of positions. The mattress rests on top of this base. It is desirable to prevent the mattress from moving with respect to the base, to keep the mattress in the correct position on the bed. A variety of methods are used to prevent a mattress from shifting past the edge of an automated bed foundation. Traditional mattress-retention methods include foot retainer bars, snaps, zippers, buckles, bars, Velcro®, clips, pockets, and non-slip fabrics or surfaces. Many of these methods help prevent a mattress from moving with respect to the base, during base articulation, such as during articulation of a Power Foundation from Leggett & Platt®. One of the main drawbacks of many of these retention methods is that they may be unsightly to a user, and may complicate the use of traditional bedding materials such as sheets or blankets on the bed. Most consumers would prefer the adjustable bed to look as much like a "normal" non-adjustable bed as possible.

Accordingly, a need exists for a reliable mattress-retention mechanism for use with an automated bedding system, which addresses the foregoing and other problems.

BRIEF SUMMARY OF THE INVENTION

The present invention generally relates to a mattress-retention mechanism that prevents a mattress from moving on an automated or adjustable bed during articulation. In one embodiment, a mattress-retention mechanism includes a rigid, elongated rod that is held between two retainer ends. The rod is held in place on the mattress within a tube installed on the bottom of the mattress. The retainer ends have a downwardly extending leg that passes through a corresponding hole in the adjustable bed base. Each leg has a toothed rack that can be engaged by a pawl. Each retainer end is held in place by a latch assembly coupled to the bottom of the adjustable bed base. Each latch assembly is located below the hole in the base. The latch assembly has a retainer block that holds a latch, and a biasing mechanism. The biasing mechanism operates to move the latch into engagement with the leg of the retainer end. More specifically, the latch has a point which is moved into engagement with the toothed rack on the leg of the retainer end. The latch includes a cam surface, which can be engaged by the leg as the leg moves downwardly through the latch assembly. As the cam is contacted, the latch moves away from the toothed rack, such that the leg can move downwardly, but not upwardly. Once installed, the mattress-retention mechanism maintains the mattress in place relative to the adjustable bed base, while being hidden from view.

Additional objects, advantages, and novel features of the invention will be set forth in part in the description which follows, and in part will become apparent to those skilled in the art upon examination of the following, or may be learned by practice of the invention.

BRIEF DESCRIPTION OF SEVERAL VIEWS OF THE DRAWING

The present invention is described in detail below with reference to the attached drawing figures, wherein.

DETAILED DESCRIPTION OF THE INVENTION

Figure 1:
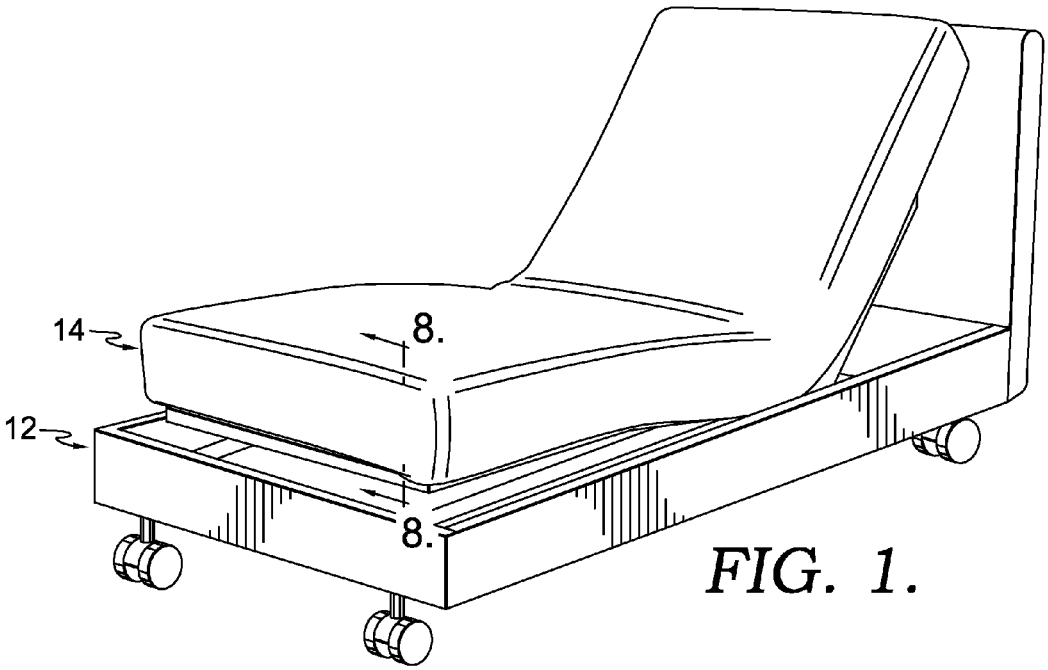
FIG. 1 is a perspective view of an adjustable bed, having a hidden mattress-retention mechanism.
Figure 2:
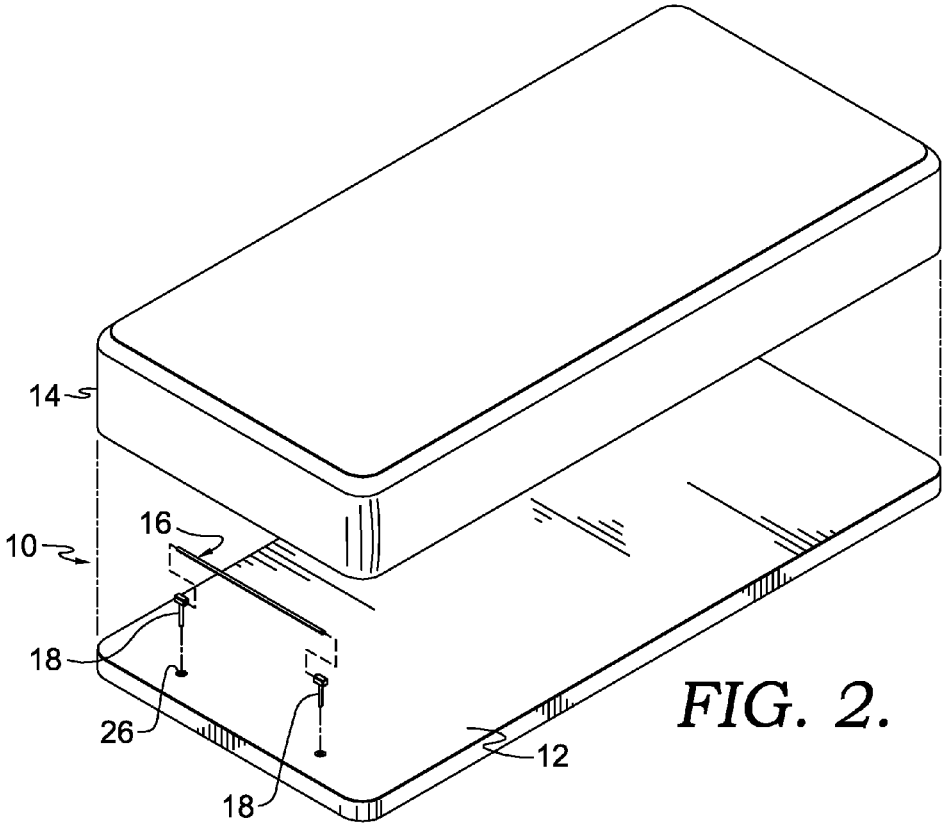
FIG. 2 is an exploded view of the mattress, base, and a portion of the mattress-retention mechanism of FIG. 1, with the base shown schematically.
Figure 8:
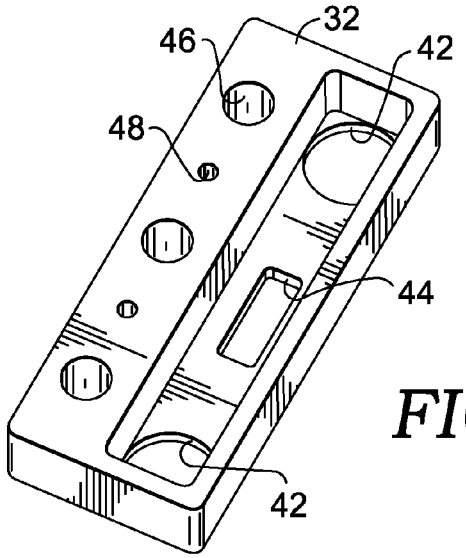
FIG. 8 is a perspective view of the retainer block component of FIG. 7.
Figure 9:
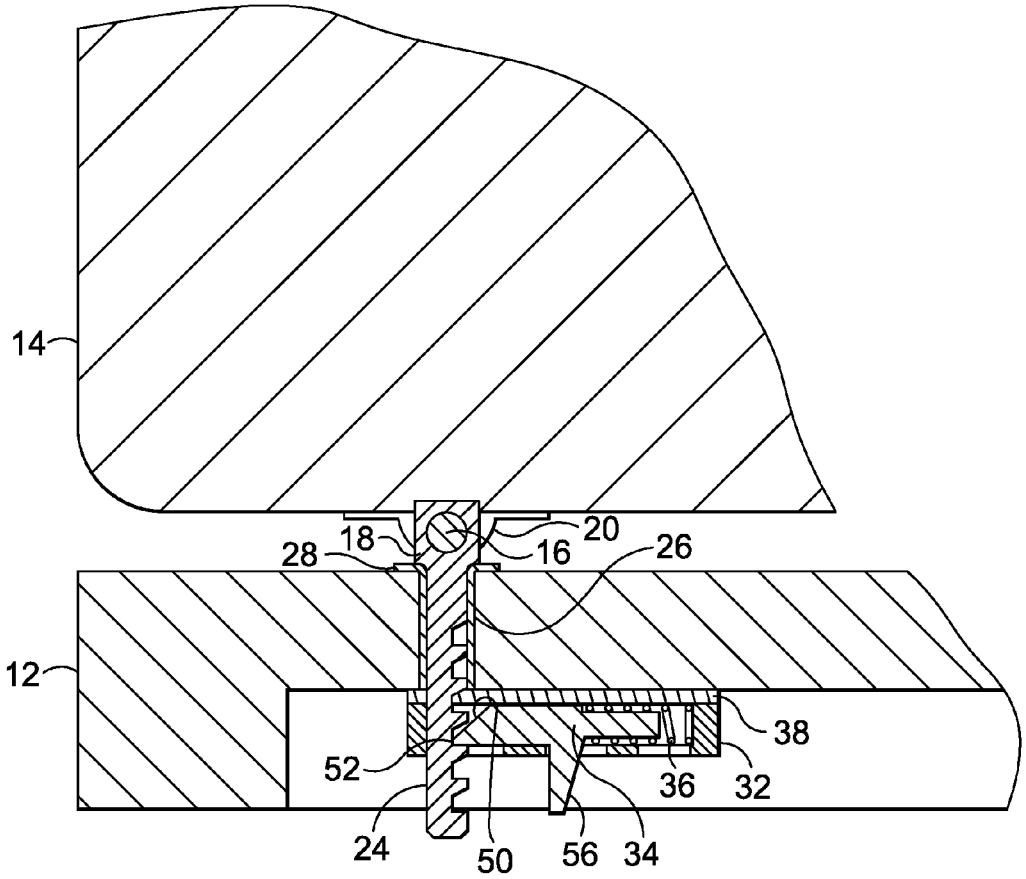
FIG. 9 is a partial, cross-sectional view taken along line 8-8 of FIG. 1.

A mattress-retention mechanism 10 is described below for use in maintaining a mattress 14 in place on an adjustable bed base 12. As shown in FIG. 1, and as understood by those of skill in the art, adjustable bed base 12 is operable to move the mattress 14 into a number of different positions. The mattress-retention mechanism 10 prevents mattress 14 from sliding out of place relative to the bed base 12. FIG. 2 shows an exploded schematic representation of some components of an exemplary mattress-retention mechanism 10 disposed between the adjustable bed base 12 and the mattress 14. It should be understood that base 12 is configured with a series of articulating panels, as is known to those of skill in the art. Mattress-retention mechanism 10 includes an elongated retainer rod 16 held between opposing retainer ends 18. Rod 16 is constructed of a material, such as steel, that will retain mattress 14 without undue bending. Rod 16 can be any of a number of shapes, including, without limitation, round, hexagonal, square, triangular, octagonal, tubular or other commercially available steel shape. As best seen in FIG. 8, rod 16 is coupled to mattress 14 by use of a tube 20 attached to the bottom of mattress 14. Tube 20 can be constructed of a sturdy material and is attached to mattress 14 such as by sewing or adhesives. The tube 20 forms an elongated pocket along the bottom of mattress 14, and the rod 16 is placed within the tube 20.

Figure 3:
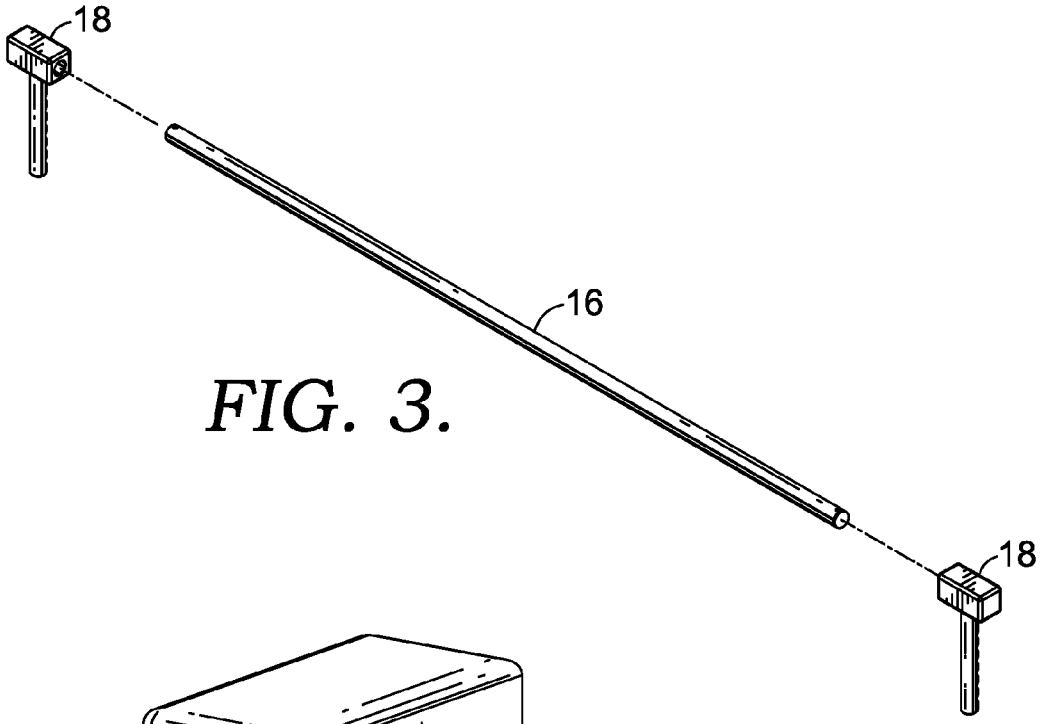
FIG. 3 is an enlarged, exploded view of the portion of the mattress-retention mechanism of FIG. 2.
Figure 4:
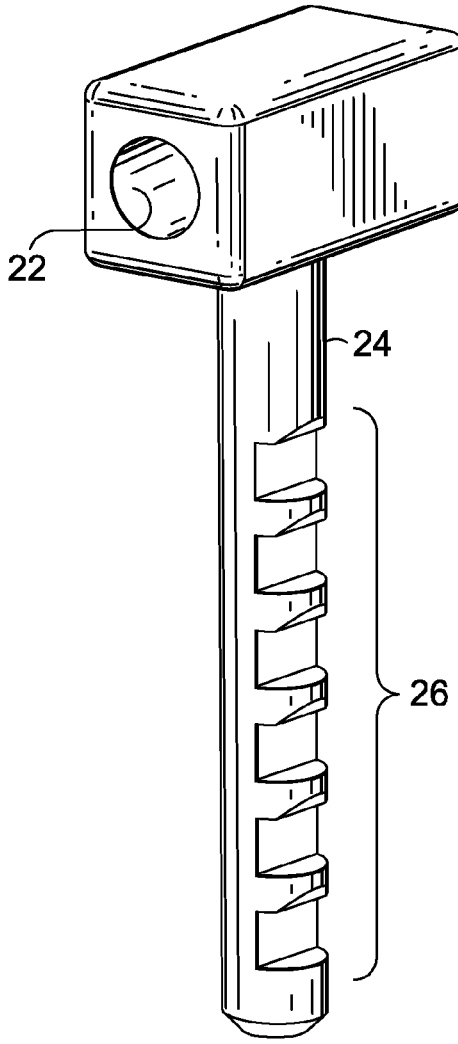
FIG. 4 is an enlarged view of one embodiment of a retainer end for use as part of the mattress-retention mechanism.

Each end of rod 16 is held in one of two retainer ends 18. As best seen in FIGS. 3 and 4, each retainer end 18 has a bore 22 shaped to correspond to and receive the end of the rod 16.

Figure 5:
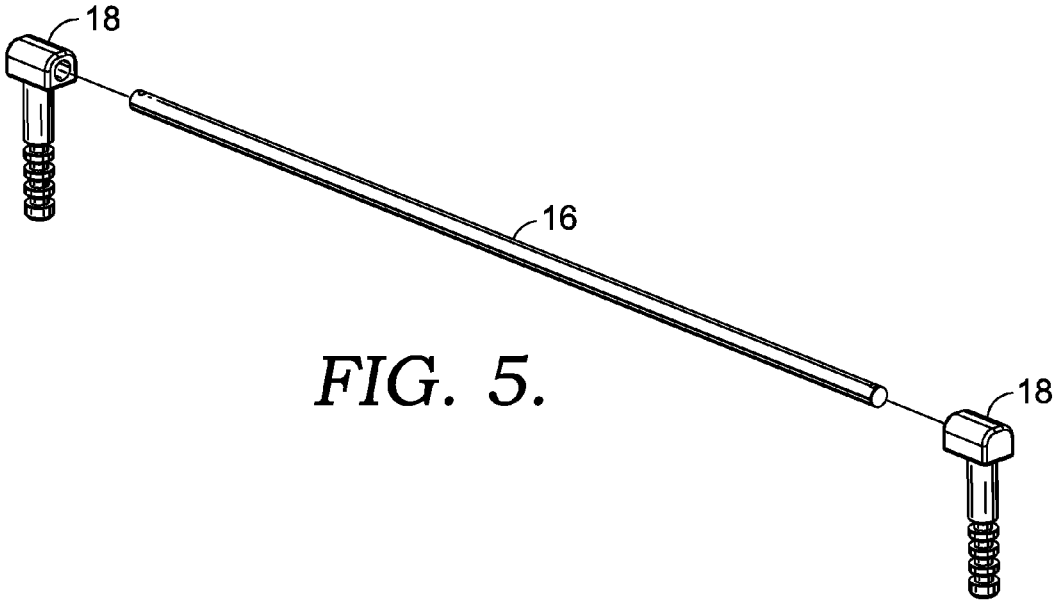
FIG. 5 is a view similar to FIG. 3 using a second embodiment of a retainer end.
Figure 6:
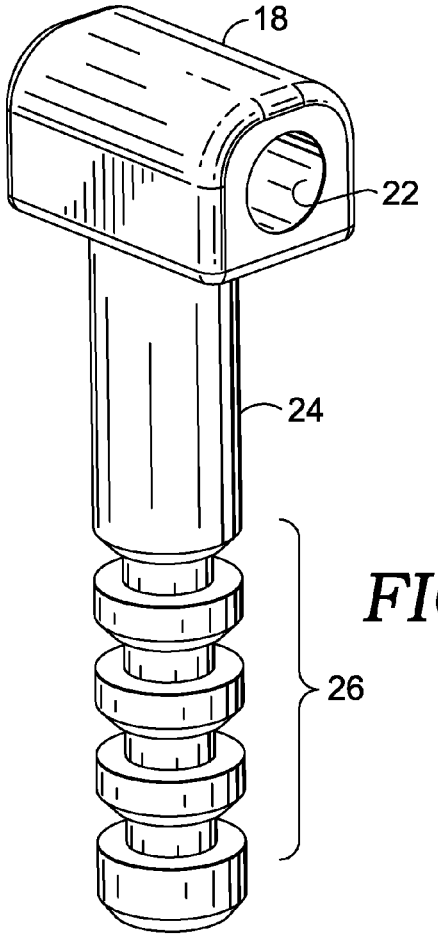
FIG. 6 is an enlarged view of a second embodiment of a retainer end for use as part of the mattress-retention mechanism.

Each retainer end 18 also has a downwardly extending leg 24, the lower end of which has a series of ridges or retaining teeth 26 that form a rack, the purpose of which is more-fully explained below. As shown, the teeth 26 along the rack extend along one side of the leg 24. In this configuration, the teeth of each retainer end 18 are oriented such that they face the same direction. An alternate embodiment is shown in FIGS. 5 and 6 where the teeth 26 are formed as annular rings along the lower end of leg 24. This allows a particular retainer to be used on either the left or right side of the bed. Retainer ends 18 can be formed from any of a number of sturdy and durable materials.

Figure 7:
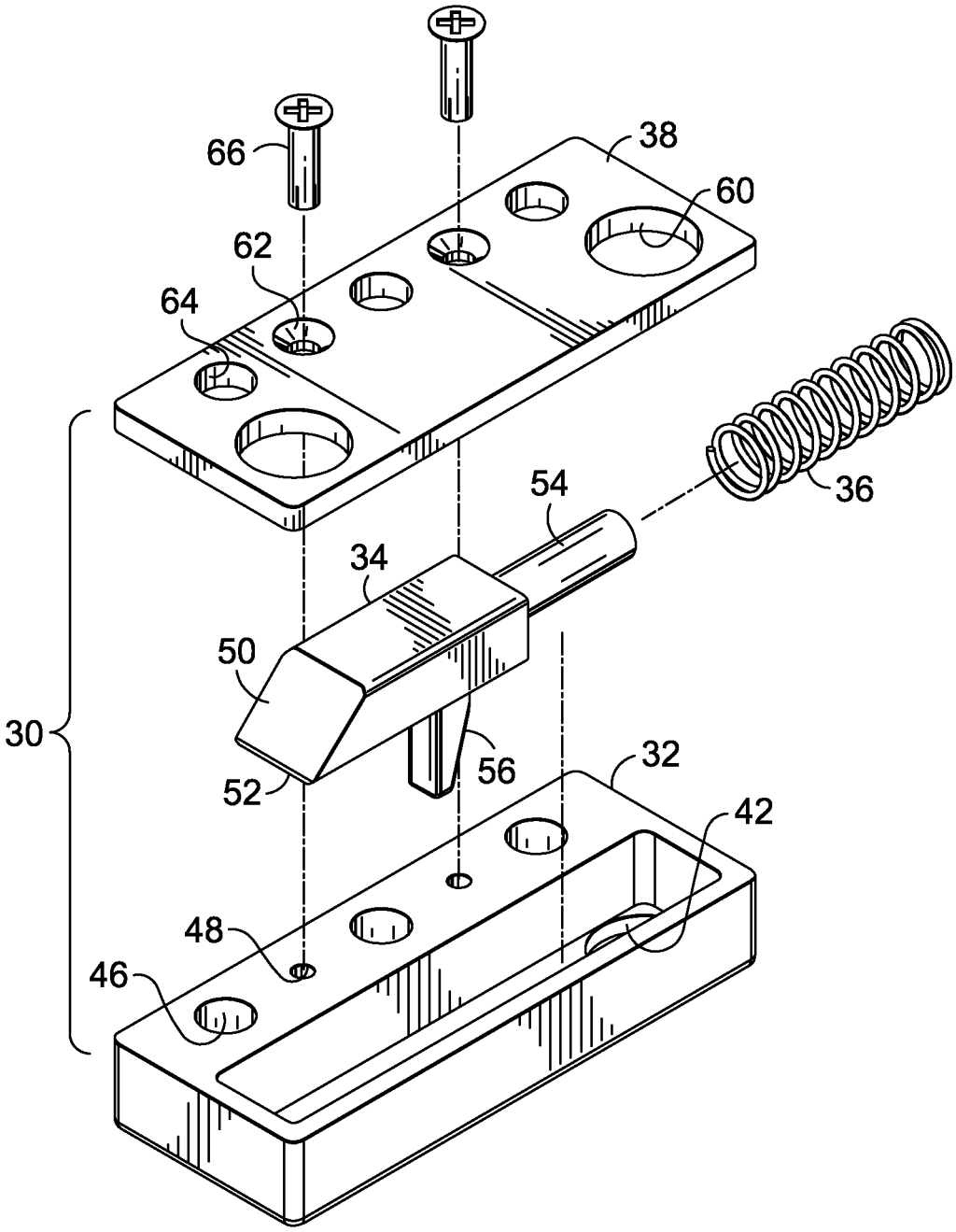
FIG. 7 is an exploded view of a latch assembly for use as part of the mattess-retention mechanism.

With continued reference to FIGS. 2 and 8, the portion of adjustable base 12 corresponding to the location of retainer ends 18 has a bore 26 aligned with a corresponding retainer end 18. Preferably, each bore 26 has a bushing 28 inserted in it, and the retainer end 18 extends through this bushing 28. A retainer latch assembly 30 is coupled to the underside of base 12 proximate each retainer end 18. As best seen in FIGS. 7 and 8, each latch assembly 30 includes a retainer block 32, a latch 34 and biasing mechanism 36, and a cover 38. As best seen in FIG. 7, the retainer block 32 has a latch channel 40 formed along one side. The channel 40 is open on one side of the retainer block 32. On the opposite side of the retainer block, channel 40 is accessible through one of two circular retainer bores 42, and a rectangular release opening 44. Retainer block 32 also has a series of spaced mounting holes 46. Retainer block 32 is illustrated having three such mounting holes 46, although it should be understood that more, or fewer, mounting holes could be used. Spaced between the mounting holes 46 are a pair of threaded holes 48, which are used to couple the cover 38 to the retainer block 32. The retainer block 32 and cover 38 can be molded, cast or machined. Further, block 32 can be made as a single block, or a split block to facilitate assembly or repair.

The latch 34 is formed with a locking wedge section 50 that tapers to a point 52. Latch 34 also has a cylindrical arm 54 extending rearwardly from section 50. A release finger 56 extends downwardly from the wedge section 50 and is positioned to extend through the release opening 44 in block 32. The wedge section 50 operates as a cam when engaged by the leg 24 of a respective retainer end 18. When the leg 24 contacts the wedge section 50, the latch 34 will move against the biasing force of biasing mechanism 36, but will move into place within the rack formed by teeth 26 because of the biasing mechanism 36. The latch 34 can be formed from a variety of materials, such as a hard plastic or can be machined or cast as a metal piece. The biasing mechanism 36 in one embodiment is an extension spring that fits around and is retained by the arm 54. The biasing mechanism operates to bias the point 52 against the retainer end as is more-fully described below. The biasing mechanism 36 and the latch 34 are held within channel 40 of block 32 by cover 38. Cover 38 is a thin plate having circular retainer boars 60 that correspond in size and location to circular boars 42 on block 32. Cover 38 also has a series of mounting holes 64 that correspond to holes 46 in block 32. In addition, cover 38 has two holes 62 that correspond in location to threaded holes 48 on block 32. Holes 62 may have a countersunk edge to accommodate two mounting screws 66 used to couple the cover 38 to the block 32. When assembled, the latch 34 and biasing mechanism 36 are placed within the channel 40 of block 32. The release finger 56 extends through the release opening 44 and is biased forwardly by the mechanism 36. The latch 34 and biasing mechanism 36 are held in place within channel 40 by the cover 38, which is coupled to block 32 using the screws 66.

As best seen in FIG. 7, the retainer block assembly 30 is coupled to the base 12 by placing screws through one or more of the holes 46 and 64, and threading the screws into base 12. As described above, the rod 16 is coupled to mattress 14 by inserting it within the tube 20, attached to the bottom of mattress 14. Each end of rod 16 is held in one of two retainer ends 18. In turn, the extending leg 24 of each retainer end 18 is placed through bushing 28 and extends below the bushing 28. Additionally, the leg 24 will extend through one of the two circular boars 42 and 60 in the assembly 30. Assembly 30 is constructed such that one configuration can be used for both the left and right hand sides by rotating the assembly 180 degrees. It should be understood that an assembly 30 could be constructed for the left side or right side use only. As the leg 24 is placed through the assembly 30, the latch 34 is moved away from the leg 24 using cam surface of wedge section 50, against the biasing force of mechanism 36. Once in place, the point 52 of latch 34 is moved by the biasing mechanism 36 into place against leg 24 and between the retaining teeth 26. The biasing force of mechanism 36, the point 52 and the teeth 26 operate in cooperation to hold retainer ends 18 in place. Because the retainer ends are coupled to rod 16, which is in turn coupled to the mattress 14, the mattress 14 will be retained in position relative to the base 12 during articulation or movement of the base, and bed. The retention mechanism is hidden from view, yet is easy to operate. Should the mattress 14 need to be removed from the base 12, the latch 34 can be released from engagement with the retainer ends 18 using release finger 56, at which time the mattress can be lifted to remove the retainer ends 18 from the base 12, thus removing the mattress 14 from engagement with the base 12.

While the assembly described above is shown in use at the foot of a bed, it should be understood that the inventive concepts can be implemented in other locations, such as at the head of the bed, or along the sides. Moreover, while shown in use as a singular system, the entire assembly could be replicated at other locations of the bed. For example, one assembly could be located at the foot of the bed, and a second assembly could be located at the head of the bed.

From the foregoing, it will be seen that this invention is one well adapted to attain all the ends and objects hereinabove set forth together with other advantages, which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

The invention claimed is:

1. A mattress-retention system, for retaining an adjustable mattress on an adjustable bed frame, comprising:

a mattress-retention sleeve coupled to the adjustable mattress;

a rod disposed at least partially within the mattress-retention sleeve, the rod having opposing first and second ends;

at least one mattress retainer end coupled to the rod, the at least one mattress retainer end having a downwardly extending leg, said leg adapted to be disposed through the adjustable bed frame; and at least one retainer block coupled to the underside of the adjustable bed frame, said at least one retainer block comprising a latch assembly, wherein the latch assembly is operable to engage said leg of said at least one mattress retainer end, wherein said at least one mattress retainer end is held in place by said latch assembly, thereby holding said mattress in place on the adjustable bed frame, wherein the leg of the at least one mattress retainer end includes a toothed rack that is engaged by the latch assembly.

2. The mattress-retention mechanism of claim 1, further comprising at least two retainer ends, with one retainer end positioned on the first end of said rod, and the other retainer end positioned on the second end of said rod.

3. The mattress-retention mechanism of claim 1, wherein the latch assembly includes a latch having an end configured to engage the toothed rack of the leg of the retainer.

4. The mattress-retention mechanism of claim 3, further comprising a biasing mechanism in the latch assembly to bias the end of the latch towards the toothed rack.

5. The mattress-retention mechanism of claim 4, wherein the at least one retainer block includes a channel within which the latch is slidably received, and wherein the end of the latch is releasable from the toothed rack by sliding the latch against the biasing force of the biasing mechanism.

6. The mattress-retention mechanism of claim 5, wherein the biasing mechanism is a spring.

7. A mattress-retention structure for maintaining a mattress on a bed base, comprising:

a releasable assembly coupled to the mattress comprising:

an elongated rigid rod having first and second ends; and a pair of retainer ends, with one retainer end coupled to the first end of the rod, and the other retainer end coupled to the second end of the rod; and a latch assembly coupled to the bed base comprising:

a pair of retainer blocks coupled to the bed base in a location corresponding to the location of the retainer ends, wherein a top surface of each of the pair of retainer blocks is coupled to an underside of the bed base, a latch held within each retainer block, the latch being engageable with an adjacent retainer end; and a biasing mechanism to maintain the engagement of the latch with the retainer end, wherein the bed base includes holes allowing at least a portion of each retainer end to extend through a corresponding hole and into a corresponding retainer block via the top surface of each of the pair of retainer blocks, and wherein the adjacent retainer end is held in place by the latch and biasing mechanism to thereby maintain the mattress in position on the bed base, wherein the retainer ends each have a downwardly extending leg having a series of engageable slots forming a rack for adjustable positioning of the leg with respect to the latch, wherein each of the engageable slots is positioned for engagement with the latch.

8. The mattress-retention structure of claim 7, further comprising a tube coupled to the mattress, the tube adapted to accommodate and retain the rod of the release assembly.

9. The mattress-retention structure of claim 7, wherein each retainer block has a channel configured to slidingly maintain the latch, and wherein the latch includes a release finger that protrudes from the retainer block, the release lever being operable to move the latch into and out of engagement with the respective retainer end.

10. The mattress-retention structure of claim 9, wherein the release assembly and latch assembly are coupled to the mattress and bed base, respectively, in a location hidden from view when the mattress is in place on the bed base.

11. The mattress-retention structure of claim 10, wherein the release assembly and latch assembly are located in the foot area of the mattress and bed base.

12. An adjustable bed base having a hidden mattress retention structure, comprising:

a pair of spaced retainer blocks coupled to the bottom of the bed base adjacent a pair of holes in the bed base, wherein a top surface of each of the pair of retainer blocks is coupled to a bottom surface of the bed base;

a pair of latches, each retainer block slidingly containing one latch; and a biasing mechanism coupled to each latch and held within the retainer blocks, the biasing mechanism maintaining the latch in a first position, wherein the latch and the corresponding biasing mechanism can be used to maintain a structure disposed through the hole in the bed base and into the top surface of the retainer block, wherein the pair of spaced retainer blocks is configured to maintain a mattress on the bed base based on maintaining the structure comprising:

an elongated rigid rod having first and second ends, said rod secured to the mattress based on at least a portion of the rod being disposed within a mattress-retention sleeve coupled to the mattress, and a pair of retainer ends, with one retainer end coupled to the first end of the rod, and the other retainer end coupled to the second end of the rod, wherein each retainer end comprises a downwardly extending leg having a series of engageable slots forming a rack for adjustable positioning of the leg with respect to the latch.

13. The adjustable bed base of claim 12, wherein each latch includes a cam surface located below the holes in the bed base, and positioned such that a structure disposed through the hole in the bed base contacts the cam surface to move the latch against the biasing force of the biasing mechanism.

14. The adjustable bed base of claim 13, wherein each latch is held within the corresponding retainer block in a channel configured to allow contained, sliding movement.

15. The adjustable bed base of claim 14, wherein the latch includes a downwardly extending release finger that extends outside the retainer block and is accessible from outside the retainer block, the release finger operable to move the latch against the biasing force of the biasing mechanism.

* * * * *